US012514299B2

(12) United States Patent
Uhrmeister et al.

(10) Patent No.: US 12,514,299 B2
(45) Date of Patent: Jan. 6, 2026

(54) METHOD AND APPARATUS FOR MANUFACTURING AN AEROSOL GENERATING POD

(71) Applicant: JT International S.A., Geneva (CH)

(72) Inventors: Peter Uhrmeister, Trier (DE); Andrew Robert John Rogan, Forres (GB)

(73) Assignee: JT International SA (CH)

( * ) Notice: Subject to any disclaimer, the term of this patent is extended or adjusted under 35 U.S.C. 154(b) by 692 days.

(21) Appl. No.: 17/613,785

(22) PCT Filed: May 26, 2020

(86) PCT No.: PCT/EP2020/064611

§ 371 (c)(1),
(2) Date: Nov. 23, 2021

(87) PCT Pub. No.: WO2020/239787

PCT Pub. Date: Dec. 3, 2020

(65) Prior Publication Data

US 2022/0240594 A1 Aug. 4, 2022

(30) Foreign Application Priority Data

May 29, 2019 (EP) ..... 19177265

(51) Int. Cl.
*A24F 40/70* (2020.01)
*A24C 5/01* (2020.01)
(Continued)

(52) U.S. Cl.
CPC ..... *A24F 40/70* (2020.01); *A24C 5/01* (2020.01); *A24C 5/28* (2013.01); *A24F 40/20* (2020.01); *A24F 40/465* (2020.01)

(58) Field of Classification Search
CPC ..... A24C 5/01; A24B 3/14
See application file for complete search history.

(56) References Cited

U.S. PATENT DOCUMENTS 5,233,813 A 8/1993 Kenney et al.
10,499,685 B2 12/2019 Prestia et al.
(Continued)

FOREIGN PATENT DOCUMENTS

CN 107427086 A 12/2017
CN 107529812 A 1/2018
(Continued)

OTHER PUBLICATIONS

International Search Report for Application No. PCT/EP2020/064611, Dated Jul. 31, 2020, 4 pages.
(Continued)

*Primary Examiner* — Michael H. Wilson
*Assistant Examiner* — Stephanie Lynn Moore
(74) *Attorney, Agent, or Firm* — Lerner David LLP

(57) ABSTRACT

A method of manufacturing an aerosol generating pod includes providing aerosol generating material; positioning sheet material over opposite sides of the aerosol generating material; and punching the aerosol generating material and the sheet material from one of the opposite sides to form an aerosol generating pod including aerosol generating material covered by the sheet material. An apparatus for manufacturing an aerosol generating pod is also provided.

13 Claims, 11 Drawing Sheets

(51) Int. Cl.

| | |
|---|---|
| ***A24C 5/28*** | (2006.01) |
| ***A24F 40/20*** | (2020.01) |
| ***A24F 40/465*** | (2020.01) |

(56) References Cited

U.S. PATENT DOCUMENTS

| | | | | |
|---|---|---|---|---|
| 2008/0092912 | A1* | 4/2008 | Robinson | H05B 3/42 131/200 |
| 2014/0261473 | A1* | 9/2014 | Carroll | A24B 15/186 131/118 |
| 2017/0055581 | A1 | 3/2017 | Wilke et al. | |
| 2018/0192687 | A1 | 7/2018 | Pijnenburg et al. | |
| 2018/0271153 | A1 | 9/2018 | John et al. | |
| 2018/0310607 | A1 | 11/2018 | Prestia et al. | |
| 2018/0352851 | A1 | 12/2018 | Prestia et al. | |
| 2019/0142068 | A1 | 5/2019 | Gill et al. | |

FOREIGN PATENT DOCUMENTS

| | | | |
|---|---|---|---|
| CN | 107920600 | A | 4/2018 |
| EP | 0482283 | A1 | 4/1992 |
| GB | 706019 | A | 3/1954 |

OTHER PUBLICATIONS

Search Report dated Sep. 6, 2022 from Office Action for Chinese Application No. 2020800385578 issued Sep. 16, 2022. 3 pgs.

* cited by examiner

METHOD AND APPARATUS FOR MANUFACTURING AN AEROSOL GENERATING POD

CROSS-REFERENCE TO RELATED APPLICATIONS

The present application is a national phase entry under 35 U.S.C. § 371 of International Application No. PCT/EP2020/064611, filed May 26, 2020, published in English, which claims priority to European Application No. 19177265.6 filed May 29, 2019, the disclosures of which are incorporated herein by reference.

TECHNICAL FIELD

The present disclosure relates generally to aerosol generating pods comprising an aerosol generating material, and more particularly to aerosol generating pods for use with an aerosol generating device for heating the aerosol generating material to generate an aerosol for inhalation by a user. Embodiments of the present disclosure relate in particular to a method and apparatus for manufacturing an aerosol generating pod.

TECHNICAL BACKGROUND

Devices which heat, rather than burn, an aerosol generating material to produce a vapour and/or aerosol for inhalation have become popular with consumers in recent years. Such devices can use one of a number of different approaches to provide heat to the aerosol generating material.

One approach is to provide an aerosol generating device which employs a resistive heating system. In such a device, a resistive heating element is provided to heat the aerosol generating material and a vapour or aerosol is generated as the aerosol generating material is heated by heat transferred from the heating element.

Another approach is to provide an aerosol generating device which employs an induction heating system. In such a device, an induction coil is provided with the device and a susceptor is provided typically with the aerosol generating material. Electrical energy is provided to the induction coil when a user activates the device which in turn generates an alternating electromagnetic field. The susceptor couples with the electromagnetic field and generates heat which is transferred, for example by conduction, to the aerosol generating material and a vapour or aerosol is generated as the aerosol generating material is heated.

Whichever approach is used to heat the vapour generating material, it can be convenient to provide the aerosol generating material in a pod which can be inserted by a user into the aerosol generating device. As such, there is a need to provide methods and apparatus suitable for manufacturing aerosol generating pods.

SUMMARY OF THE DISCLOSURE

According to a first aspect of the present disclosure, there is provided a method of manufacturing an aerosol generating pod, the method comprising:

(i) providing aerosol generating material;

(ii) positioning sheet material over opposite sides of the aerosol generating material;

(iii) punching the aerosol generating material and the sheet material from one of the opposite sides to form an aerosol generating pod comprising aerosol generating material covered by the sheet material.

According to a second aspect of the present disclosure, there is provided apparatus for manufacturing an aerosol generating pod, the apparatus comprising:

a first supply unit for supplying aerosol generating material;

a second supply unit for positioning sheet material over opposite sides of the aerosol generating material; and a punching unit arranged to punch the aerosol generating material and the sheet material from one of the opposite sides to form an aerosol generating pod comprising aerosol generating material covered by the sheet material.

As used herein, the term "punching", or its equivalents such as punch, etc., means a forming process that cuts through a material (e.g. the aerosol generating material, the sheet material, or an inductively heatable susceptor sheet) to separate the material from remaining material via shearing. A hole may be created in the material via shearing during punching of the material.

The aerosol generating pod is for use with an aerosol generating device for heating the aerosol generating material, without burning the aerosol generating material, to volatise at least one component of the aerosol generating material and thereby generate a heated vapour which cools and condenses to form an aerosol for inhalation by a user.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The aerosol generating pod can be manufactured efficiently using the method and apparatus according to the present disclosure. The aerosol generating pod has a simple construction in which the aerosol generating material is covered by the sheet material. The aerosol generating material can be covered by one or more sheets of the sheet material, thereby allowing flexibility in the manufacturing process. The aerosol generating pod can be used as it is and also can be used to produce an aerosol generating article in any shape such as a stick shape. In this case, the aerosol generating pod can be attached to a mouthpiece and wrapped together with the mouthpiece, for example to make a stick-shaped aerosol generating article.

In one aspect of the method:

step (i) may comprise supplying aerosol generating material having a continuous profile;

step (ii) may comprise supplying continuous sheet material over opposite sides of the continuous profile of aerosol generating material; and step (iii) may comprise repeatedly punching the continuous profile of aerosol generating material and the continuous sheet material from one of the sides of the sheet material to form a plurality of aerosol generating pods comprising aerosol generating material covered by the sheet material.

This aspect of the method facilitates mass production of aerosol generating pods.

The aerosol generating material may be any type of solid or semi-solid material. Example types of aerosol generating material include powder, granules, particles, gel, strips, loose leaves, cut filler, pellets, powder, shreds, strands, foam material and sheets. The continuous profile of the aerosol generating material may comprise a continuous supply of aerosol generating material.

The foam material may comprise a plurality of fine particles (e.g. tobacco particles) and can also comprise a volume of water and/or a moisture additive, such as a humectant. The foam material may be porous, and may allow a flow of air and/or vapour through the foam material.

The aerosol generating material may comprise plant derived material and in particular, may comprise tobacco. The aerosol generating material may, for example, comprise cut filler tobacco or reconstituted tobacco including tobacco and any one or more of cellulose fibres, tobacco stalk fibres and inorganic fillers such as CaCO3.

The aerosol generating material may comprise an aerosol-former. Examples of aerosol-formers include polyhydric alcohols and mixtures thereof such as glycerine or propylene glycol. Typically, the aerosol generating material may comprise an aerosol-former content of between approximately 5% and approximately 50% on a dry weight basis. In some embodiments, the aerosol generating material may comprise an aerosol-former content of between approximately 10% and approximately 20% on a dry weight basis, and possibly approximately 15% on a dry weight basis.

The method may further comprise:

(iv) positioning an inductively heatable susceptor in the aerosol generating material.

The use of an inductively heatable susceptor provides a convenient, effective and energy efficient way to heat the aerosol generating material. When the aerosol generating pod is positioned in an aerosol generating device and exposed to an alternating electromagnetic field, heat is generated in the inductively heatable susceptor due to eddy currents and magnetic hysteresis losses resulting in a conversion of energy from electromagnetic to heat. The heat generated in the inductively heatable susceptor is transferred to the aerosol generating material, thereby heating the aerosol generating material to generate a vapour which cools and condenses to form an aerosol with the desired characteristics.

The inductively heatable susceptor may comprise one or more, but not limited, of aluminium, iron, nickel, stainless steel and alloys thereof, e.g. Nickel Chromium or Nickel Copper.

The inductively heatable susceptor may comprise a particulate susceptor material. Step (iv) may comprise positioning particulate susceptor material in the aerosol generating material. The use of particulate susceptor material may provide for uniform heat transfer to the aerosol generating material, in particular when the particulate susceptor material is evenly distributed in the aerosol generating material.

The inductively heatable susceptor may comprise an inductively heatable susceptor sheet. Step (iv) may comprise positioning an inductively heatable susceptor sheet in the aerosol generating material. In one aspect, step (iv) may comprise positioning a plurality of inductively heatable susceptor sheets in the aerosol generating material, for example two or more sheets. The use of inductively heatable susceptor sheets may ensure that heat is uniformly generated throughout the aerosol generating pod during use of the pod in an inductively heatable aerosol generating device. The position of the susceptor sheet(s) in the aerosol generating pod can also be easily controlled.

The inductively heatable susceptor sheet may include an aperture. Step (iv) may comprise positioning an inductively heatable susceptor sheet including an aperture in the aerosol generating material. The inductively heatable susceptor sheet may include a plurality of apertures spaced uniformly along a longitudinal direction of the sheet. Step (iv) may comprise positioning an inductively heatable susceptor sheet including a plurality of apertures spaced uniformly along a longitudinal direction of the sheet in the aerosol generating material. The use of an inductively heatable susceptor sheet including one or more apertures may facilitate the generation of eddy currents within the sheet, for example around a circular path, and/or may facilitate the flow of air and vapour through the aerosol generating pod, for example towards an outlet (e.g. a mouthpiece) of an aerosol generating device.

Step (i) may comprise positioning aerosol generating material between the sheet material and an inductively heatable susceptor sheet and/or between inductively heatable susceptor sheets. Such an arrangement may maximise heat transfer to the aerosol generating material, which may maximise the amount of aerosol that is generated and at the same time may maximise energy efficiency.

Step (i) may comprise providing cut filler aerosol generating material, for example cut filler tobacco. The use of cut filler material may advantageously facilitate the flow of air and vapour through the aerosol generating pod, for example towards an outlet (e.g. a mouthpiece) of an aerosol generating device.

Step (i) may comprise supplying a sheet of aerosol generating material. Step (i) may comprise positioning a plurality of sheets of aerosol generating material, for example two or more sheets of aerosol generating material, between inductively heatable susceptor sheets. The method thus allows aerosol generating pods to be manufactured efficiently and reliably since the sheet(s) can be easily supplied and the position of the sheet(s) can be easily controlled.

Step (i) may comprise supplying a sheet of aerosol generating material including a plurality of perforations. The perforations advantageously facilitate the flow of air and vapour through the aerosol generating material during use of the aerosol generating pod in an aerosol generating device. The perforations allow the air permeability of the resultant aerosol generating pod to be carefully controlled and optimised. For example, the sheet of aerosol generating material may have an air permeability of about 50 to about 24,000 CORESTA Units (CU) and preferably of about 4,000 to about 24,000 CORESTA Units (CU).

Step (i) may comprise supplying a creped sheet of aerosol generating material. The use of a creped sheet of aerosol generating material may advantageously facilitate the flow of air and vapour through the aerosol generating pod, for example towards an outlet (e.g. a mouthpiece) of an aerosol generating device.

Step (i) may comprise supplying a calendered sheet of aerosol generating material. The use of a calendered sheet of aerosol generating material may advantageously allow the thickness and/or density of the aerosol generating sheet to be optimised, thereby ensuring that an aerosol having optimum characteristics is generated during use of the aerosol generating pod in an aerosol generating device.

The sheet material may be air permeable. Step (ii) may comprise positioning air-permeable sheet material over opposite sides of the continuous profile of aerosol generating material. The use of an air-permeable sheet material may advantageously facilitate the flow of air and vapour through the aerosol generating pod during use in an aerosol generating device. The air permeable sheet material may also act as a filter. Alternatively, the sheet material may comprise a material that is not air permeable, but which comprises appropriate perforations or openings to allow air and vapour to flow therethrough.

The method may further comprise prior to step (iii):

(v) cutting the sheet material positioned on at least one side of the aerosol generating material to separate it from the remaining sheet material or creating a weakened region in the sheet material positioned on at least one side of the aerosol generating material to facilitate cutting and separation of the sheet material from the remaining sheet material during step (iii).

The weakened region may comprise any one or more of a groove, score, perforations, a weakened line, or similar.

The step of cutting the sheet material may comprise cutting the sheet material positioned on both sides of the aerosol generating material, for example on an upper side and a lower side. A cutting area on one side, for example the upper side, of the aerosol generating material may be smaller than a cutting area on the other side, for example the lower side, of the aerosol generating material. This ensures that the cut sheet material on said other side, for example the lower side, of the aerosol generating material has a larger surface area that is capable of covering exposed regions, for example side regions, of the aerosol generating material.

Step (iii) may comprise moving a punching element towards the sheet material positioned on one side of the aerosol generating material and into a cavity of a mould adjacent to the sheet material positioned on the other side of the aerosol generating material. The punching element may have a circular cross-section. The cavity of the mould may have a circular cross-section to receive the punching element. The use of a punching element and mould provides a convenient way to punch the aerosol generating material and the sheet material to form the aerosol generating pod by creating a hole via shearing in the aerosol generating material and the sheet material.

The use of a punching element and a cavity with a circular cross-section may advantageously produce an aerosol generating pod which has a circular cross-section. A circular cross-section may be advantageous, for example as compared to a square or triangular cross-section, because pressure is evenly distributed on the sheet material and the aerosol generating material thereby facilitating a smooth punching operation and/or because the side wall of the aerosol generating pod does not have an edge, thus allowing side regions of the aerosol generating material to be easily wrapped uniformly by the sheet material positioned on said other side of the aerosol generating material.

Step (iii) may comprise moving a punching element towards the sheet material positioned on one side of the aerosol generating material and pushing the sheet material positioned on the opposite side of the aerosol generating material into a cavity of a mould to thereby wrap exposed regions of the aerosol generating material with the sheet material. Exposed regions, for example side regions, of the aerosol generating material are conveniently wrapped and covered during movement of the punching element into the cavity of the mould.

The sheet material on said opposite side of the aerosol generating material may be deformed as it is pushed into the cavity of the mould during step (iii). For example, the sheet material on said opposite side of the aerosol generating material may comprise a deformable material, e.g. a material which may experience elastic deformation or plastic deformation. Thus, the sheet material on said opposite side of the aerosol generating material may be stretched, e.g. elastically or plastically, as it is pushed into the cavity during step (iii). The deformation, e.g. stretching, of the sheet material helps to ensure that the exposed regions, for example side regions, of the aerosol generating material are wrapped and covered during movement of the punching element into the cavity of the mould.

The sheet material positioned on said one side of the aerosol generating material may be cut and separated via shearing from the remaining sheet material by the punching element. In embodiments in which an inductively heatable susceptor sheet is positioned in the aerosol generating material, the inductively heatable susceptor sheet may be cut and separated via shearing from the remaining susceptor sheet during movement of the punching element into the cavity of the mould. The method thus allows aerosol generating pods to be manufactured efficiently and reliably.

In one aspect, the method may further comprise after step (iii):

(vi) joining the sheet material positioned on opposite sides of the aerosol generating material to secure the aerosol generating material, and optionally the inductively heatable susceptor, inside the sheet material.

Step (vi) may comprise joining the sheet material positioned on opposite sides of the aerosol generating material by heating the sheet material, for example using a sealing heater. The aerosol generating material and the optional inductively heatable susceptor are thereby reliably positioned inside, and enclosed by, the sheet material to form a sealed aerosol generating pod.

The method may further comprise:

(vii) releasing the aerosol generating pod from the cavity of the mould.

The mould may comprise separable mould parts and step (vii) may comprise separating the mould parts to release the aerosol generating pod from the cavity of the mould. The aerosol generating pod can thus be reliably released from the cavity.

In one aspect, the sheet material may comprise a first sheet material positioned on one side of the aerosol generating material and a second sheet material positioned on the opposite side of the aerosol generating material. The first sheet material may be positioned on a first side of the aerosol generating material, e.g. adjacent to the punching element, and the second sheet material may be positioned on a second side of the aerosol generating material, e.g. adjacent to the mould.

The method may further comprise:

(viii) transferring the first sheet material, the second sheet material and the aerosol generating material to a punching position overlying the cavity of the mould.

In embodiments in which an inductively heatable susceptor is positioned in the aerosol generating material, the inductively heatable susceptor is transferred to the punching position during transfer of the aerosol generating material to the punching position.

The first sheet material, the second sheet material and the aerosol generating material may be moved by the same distance to transfer the first sheet material, the second sheet material and the aerosol generating material to the punching position. The manufacturing method is thereby simplified. Alternatively, the aerosol generating material along with one of the first sheet material and the second sheet material may be moved by a smaller distance than the other of the first sheet material and the second sheet material to transfer the first sheet material, the second sheet material and the aerosol generating material to the punching position. This may provide an efficient use of the sheet material.

The first supply unit may comprise a plurality of rollers which may be adapted to supply one or more creped or calendered sheets of aerosol generating material.

The apparatus may comprise a second supply unit, e.g. a supply roller, for supplying first sheet material over one side of the aerosol generating material and may comprise a second supply unit, e.g. a supply roller, for supplying second sheet material over the opposite side of the aerosol generating material.

The apparatus may comprise a third supply unit for positioning an inductively heatable susceptor in the aerosol generating material. As noted above, the use of an inductively heatable susceptor provides a convenient, effective and energy efficient way to heat the aerosol generating material.

The punching unit may comprise a punching element adjacent to the sheet material positioned on one side of the aerosol generating material and a mould having a cavity adjacent to the sheet material positioned on the opposite side of the aerosol generating material. The punching element may be movable into the cavity of the mould to form the aerosol generating pod. The use of a punching element and mould facilitates manufacture of aerosol generating pods.

The punching element may include a peripheral wall which may have a peripheral edge. The punching element may have a circular cross-section and, hence, may include a circular peripheral wall which may have circular peripheral edge. The peripheral edge may be adapted to separate the sheet material positioned on the side of the aerosol generating material adjacent to the punching element from the remaining sheet material positioned on said side via shearing. The peripheral edge may be adapted to separate a portion of the aerosol generating material from the surrounding aerosol generating material via shearing. The peripheral edge may be adapted to push the sheet material positioned on the opposite side of the aerosol generating material into the cavity of the mould to thereby wrap exposed regions of the aerosol generating material with the sheet material.

In embodiments in which an inductively heatable susceptor sheet is positioned in the aerosol generating material, the peripheral edge may be adapted to cut the inductively heatable susceptor sheet to separate it via shearing from the remaining susceptor sheet. The apparatus thus allows inductively heatable aerosol generating pods to be manufactured efficiently and reliably.

The punching element may include an end wall. The end wall and the peripheral wall may define a hollow portion for receiving the separated portion of the aerosol generating material and the separated sheet material on the side of the aerosol generating material adjacent to the punching element.

The apparatus may further comprise a joining unit adapted to join the sheet material (e.g. the first sheet material and the second sheet material) positioned on opposite sides of the aerosol generating material to secure the aerosol generating material inside the sheet material. The joining unit may comprise a sealing heater. The use of a joining unit ensures that the aerosol generating material and the optional inductively heatable susceptor are reliably positioned inside, and enclosed by, the sheet material to form a sealed aerosol generating pod.

DETAILED DESCRIPTION OF EMBODIMENTS

Embodiments of the present disclosure will now be described by way of example only and with reference to the accompanying drawings.

Figure 1:
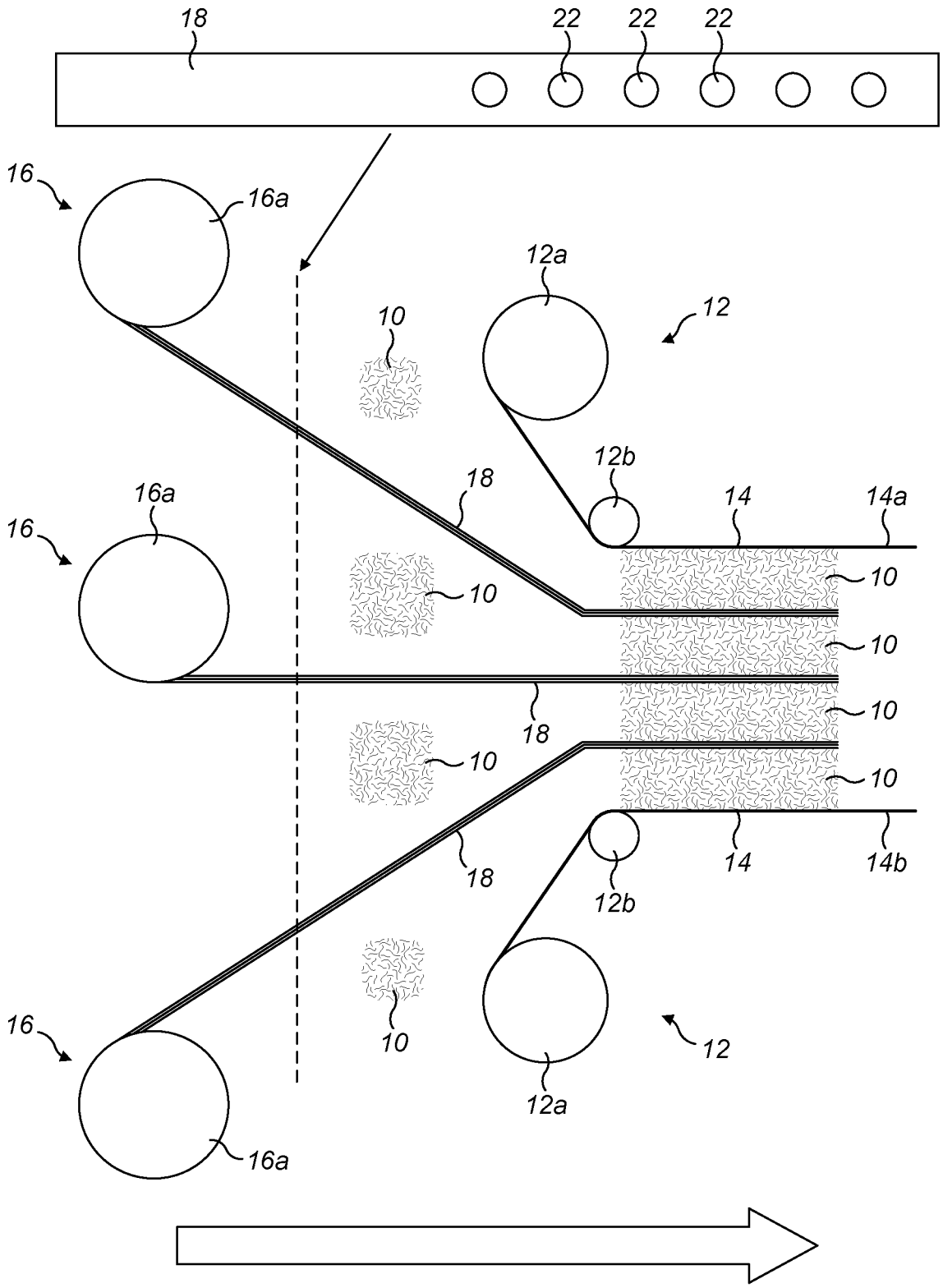
FIG. 1 is diagrammatic cross-sectional side view of part of a method and apparatus for manufacturing an aerosol generating pod, illustrating one way of positioning aerosol generating material and inductively heatable susceptor sheets between sheet material.
Figure 16A:
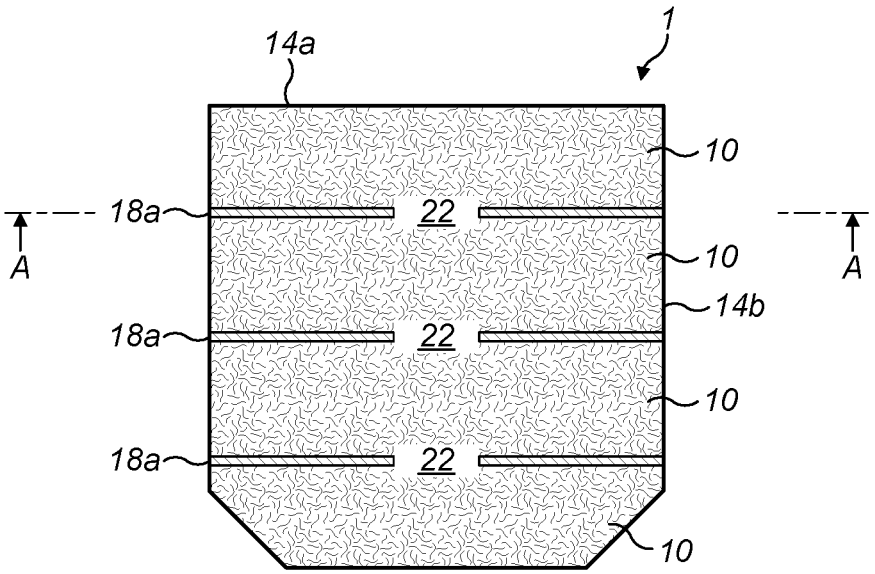
FIG. 16*a* is a diagrammatic cross-sectional side view of an example of an aerosol generating pod manufactured using the method and apparatus illustrated in FIGS. 1 to 15.
Figure 16B:
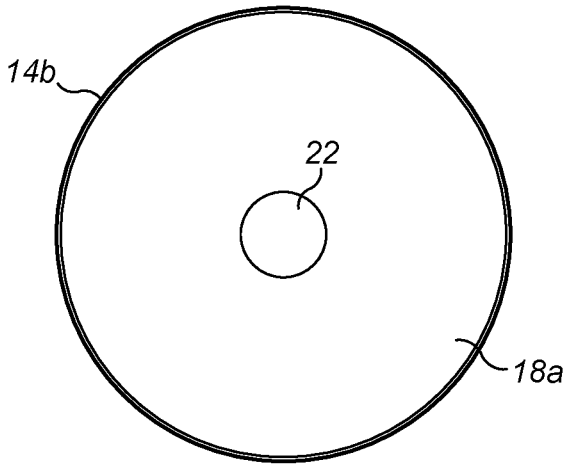
FIG. 16*b* is a cross-sectional view along the line A-A shown in FIG. 16*a*.

Referring initially to FIG. 1, there is shown a first example of part of an apparatus for manufacturing an aerosol generating pod 1 as shown in FIGS. 16*a* and 16*b*. The aerosol generating pod 1 is for use in an aerosol generating device to generate an aerosol for inhalation by a user of the device. Suitable aerosol generating devices are known generally in the art and will not be described in further detail in this specification.

The apparatus comprises a first supply unit for supplying aerosol generating material 10, second supply units 12 for positioning sheet material 14 over opposite sides of the aerosol generating material 10 and third supply units 16 for positioning an inductively heatable susceptor 18 in the aerosol generating material 10. The horizontal arrow at the bottom of FIG. 1 illustrates the process flow direction, that is the direction of movement of the aerosol generating material 10, the sheet material 14 and the inductively heatable susceptor 18.

In more detail, each of the second supply units 12 comprises a supply roller 12*a* and a feed roller 12*b* which are arranged to position first sheet material 14*a* on one side of the aerosol generating material 10 and second sheet material 14*b* on an opposite side of the aerosol generating material 10. The first sheet material 14*a* and second sheet material 14*b* is intended to cover the aerosol generating material 10 in the aerosol generating pod 1 and, thus, typically comprises an air-permeable material which allows air and vapour to flow into and out of the aerosol generating pod 1 and through the aerosol generating material 10.

Each of the third supply units 16 comprises a supply roller 16*a* which is arranged to supply an inductively heatable susceptor sheet 18 and to position the inductively heatable susceptor sheet 18 in the aerosol generating material 10. In the illustrated embodiment, each of the inductively heatable susceptor sheets 18 includes a plurality of apertures 22 which are spaced uniformly along a longitudinal direction of the susceptor sheets 18. The apertures 22 facilitate the generation of eddy currents in the inductively heatable susceptor sheets 18 during use of the aerosol generating pod 1 in an inductively heatable aerosol generating device and/or facilitate the flow of air and vapour through the aerosol generating pod 1. It will, however, be understood by one of ordinary skill in the art that the apertures 22 are not essential and may be omitted.

The aerosol generating material 10 supplied by the first supply unit is positioned between adjacent inductively heatable susceptor sheets 18. The aerosol generating material 10 is also positioned by the first supply unit between the first sheet material 14*a* and the uppermost inductively heatable susceptor sheet 18 as viewed in FIG. 1 and between the second sheet material 14*b* and the lowermost inductively heatable susceptor sheet 18 as viewed in FIG. 1. This ensures that the aerosol generating material 10 is uniformly distributed throughout the aerosol generating pod 1 as best seen in FIG. 16*a*.

In the example of FIG. 1, the aerosol generating material 10 is typically a cut filler material, for example a plant derived cut filler material such as cut filler tobacco.

The aerosol generating material 10 may comprise an aerosol-former such as glycerine or propylene glycol. Typically, the aerosol generating material 10 comprises an aerosol-former content of between approximately 5% and approximately 50% on a dry weight basis. Upon heating, the aerosol generating material 10 releases volatile compounds possibly including nicotine or flavour compounds such as tobacco flavouring.

Figure 2:
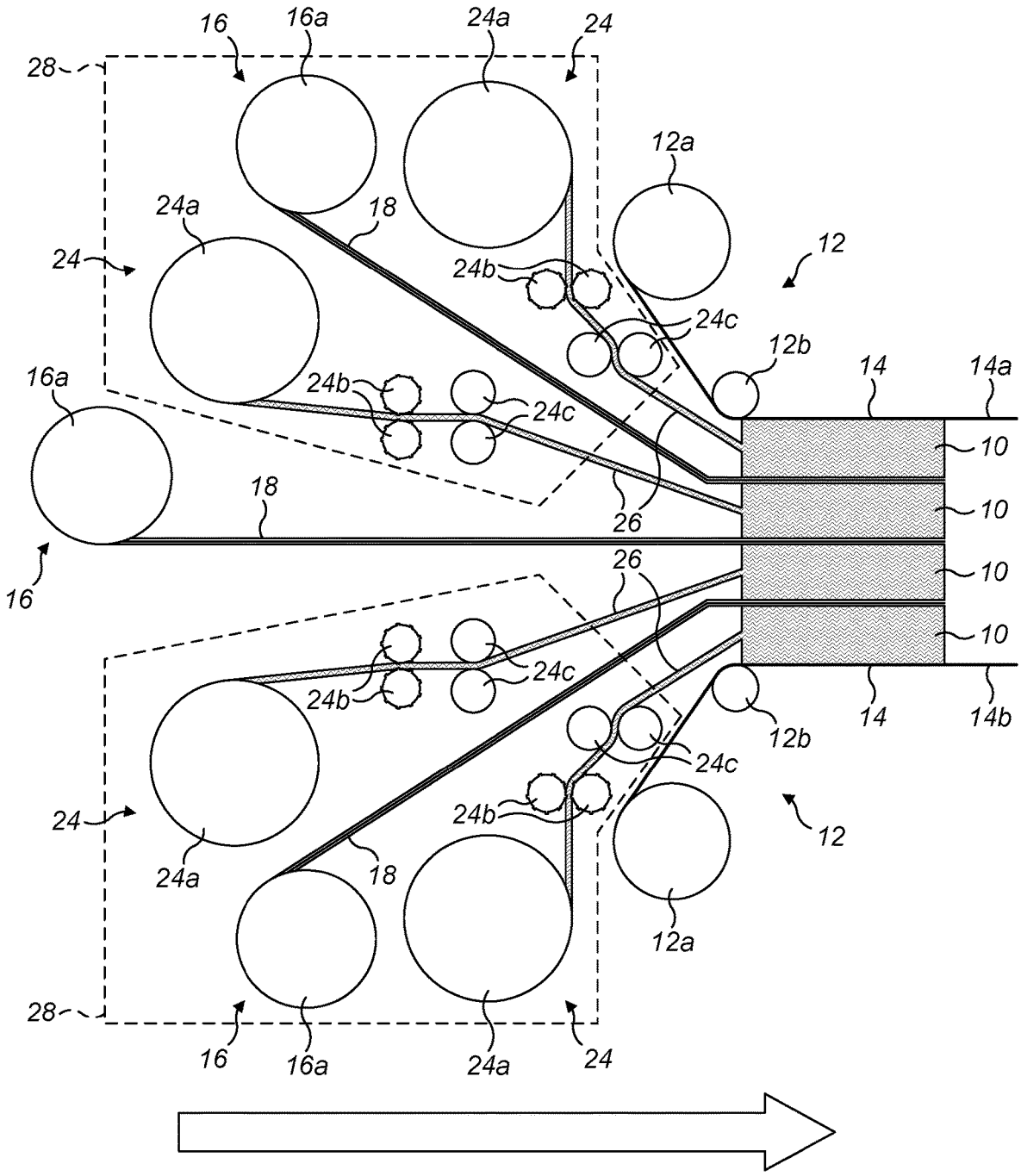
FIG. 2 is a diagrammatic cross-sectional side view of part of a method and apparatus for manufacturing an aerosol generating pod, illustrating another way of positioning aerosol generating material and inductively heatable susceptor sheets between sheet material.

Referring now to FIG. 2, there is shown a second example of part of an apparatus for manufacturing an aerosol generating pod. The apparatus shares some similarities with the apparatus described above with reference to FIG. 1 and corresponding features are identified using the same reference numerals. Again, the horizontal arrow at the bottom of FIG. 2 illustrates the process flow direction, that is the direction of movement of the aerosol generating material 10, the sheet material 14 and the inductively heatable susceptor 18.

The apparatus comprises second supply units 12 for positioning sheet material 14 over opposite sides of the aerosol generating material 10 and third supply units 16 for positioning inductively heatable susceptor sheets 18 in the aerosol generating material 10. The second and third supply units 12, 16 are the same as those described above with reference to FIG. 1.

The apparatus also comprises first supply units 24 for supplying the aerosol generating material 10. Each of the first supply units 24 comprises a supply roller 24*a* which is typically arranged to supply aerosol generating material 10 having a continuous profile, for example in the form of an aerosol generating sheet 26. The aerosol generating material 10 typically comprises a reconstituted material, for example reconstituted tobacco including tobacco and any one or more of cellulose fibres, tobacco stalk fibres and inorganic fillers such as CaCO3.

Each of the first supply units 24 includes first cooperating rollers 24*b* (e.g. perforating rollers) which are adapted to perforate the aerosol generating sheet 26 as it passes through the rollers 24*b* to facilitate the flow of air and vapour through the aerosol generating sheets 26. Each of the first supply units 24 also includes second cooperating rollers 24*c*, for example calender rollers to provide a calendered aerosol generating sheet 26 or creping rollers to provide a creped aerosol generating sheet 26.

The aerosol generating material 10 supplied by each of the first supply units 24 is positioned between adjacent inductively heatable susceptor sheets 18. The aerosol generating material 10 is also positioned between the first sheet material 14*a* and the uppermost inductively heatable susceptor sheet 18 as viewed in FIG. 2 and between the second sheet material 14*b* and the lowermost inductively heatable susceptor sheet 18 as viewed in FIG. 2.

The apparatus of FIG. 2 includes a plurality of supply assemblies 28, each supply assembly 28 comprising two first supply units 24 and a third supply unit 16 which is arranged to position an inductively heatable susceptor sheet 18 in the aerosol generating material 10 supplied by the first supply units 24. It will be understood that the apparatus could comprise any suitable number of the supply assemblies 28, provided that a third supply unit 16 is positioned between adjacent supply assemblies 28 as shown in FIG. 2.

Referring now to FIGS. 3 to 14, there is shown a further part of the apparatus for manufacturing the aerosol generating pod 1 shown in FIGS. 16*a* and 16*b* and which is positioned downstream of the part of the apparatus illustrated in FIGS. 1 and 2. The apparatus includes a punching unit 30 for punching the aerosol generating material 10 and the sheet material 14 from one of the opposite sides of the sheet material 14 to form the aerosol generating pod 1 shown in FIGS. 16*a* and 16*b*.

Figure 8:
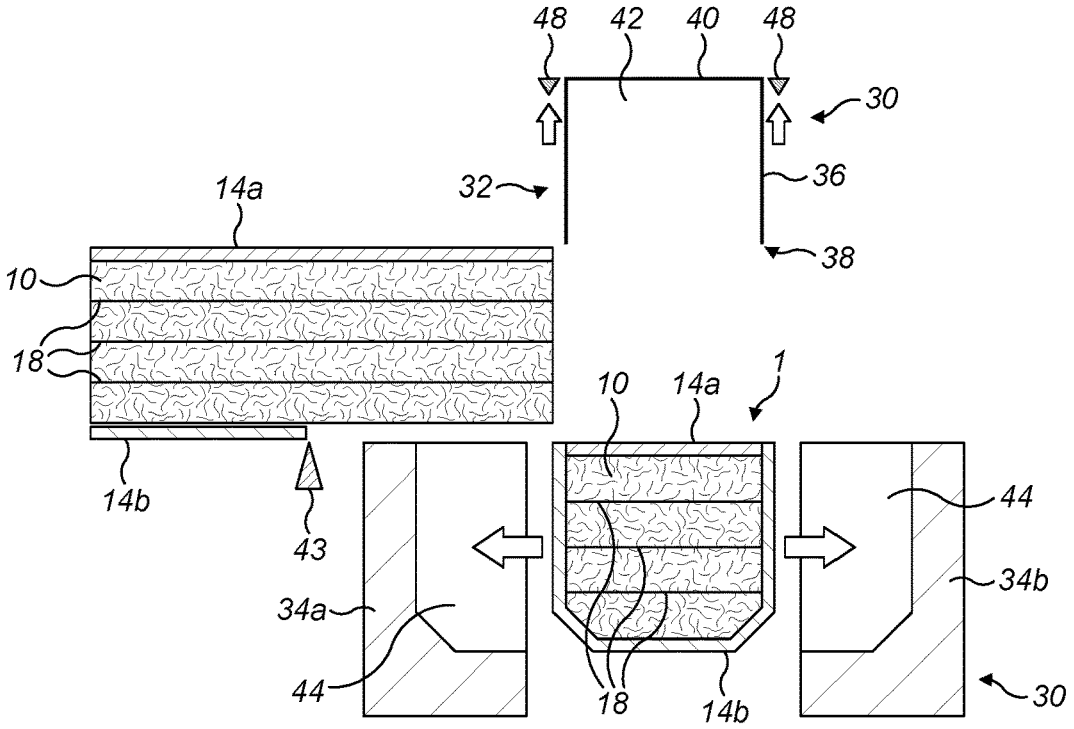

In more detail, the punching unit 30 comprises a punching element 32 positioned adjacent to the first sheet material 14*a* and a cooperating mould 34 positioned adjacent to the second sheet material 14*b*. The punching element 32 is generally circular in cross-section and includes a peripheral wall 36 having a peripheral edge 38. The punching element 32 also includes an end wall 40 which, together with the peripheral wall 36, defines a hollow interior portion 42. The mould 34 includes a cavity 44 which also has a circular cross-section and into which the punching element 32 can be moved. The mould 34 includes first and second mould parts 34*a*, 34*b* which can be separated, for example as shown in FIG. 8.

Figure 3:
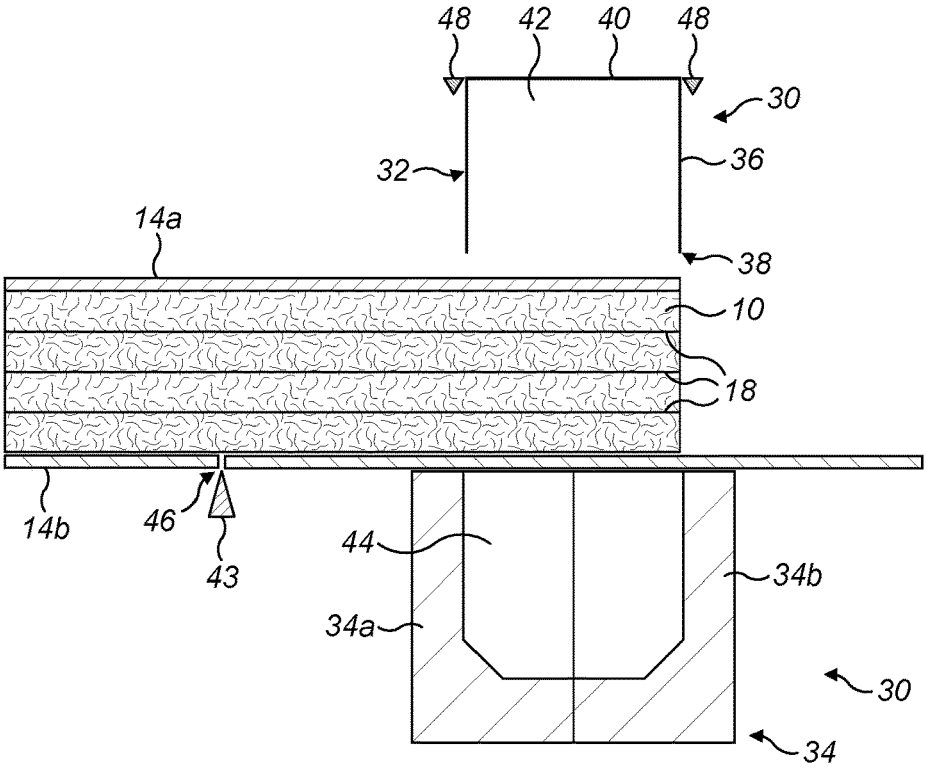
FIGS. 3 to 12 are diagrammatic views of a further part of a method and apparatus for manufacturing an aerosol generating pod.

The aerosol generating material 10, the inductively heatable susceptor sheets 18 positioned in the aerosol generating material 10 and the first and second sheet material 14*a*, 14*b* produced by the upstream part of the apparatus shown in FIGS. 1 and 2 are advanced by the first, second and third supply units to a punching position shown in FIG. 3. The apparatus includes a cutting unit 43 that is adapted to cut the second sheet material 14*b* when the second sheet material 14*b* is in the punching position, for example to separate it from the remaining second sheet material 14*b* (shown to the left of the cutting unit 43 in FIG. 3) or to create a weakened region 46 in the second sheet material 14*b*, for example comprising any one or more of a groove, score, perforations, a weakened line, or similar.

Figure 4:
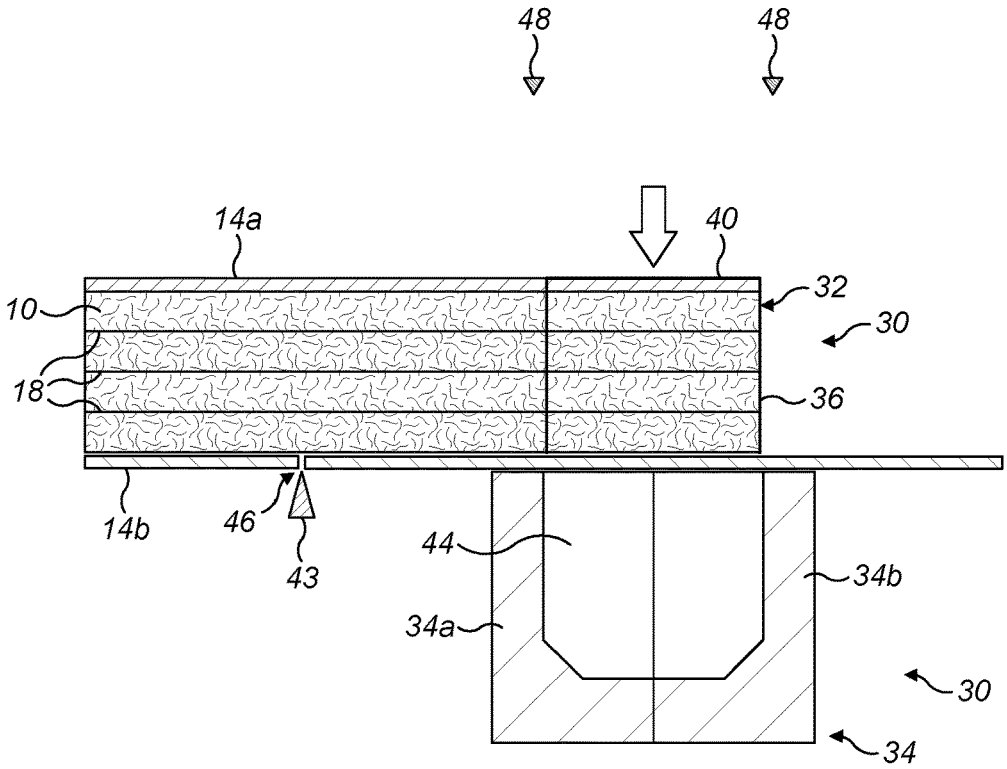

With the aerosol generating material 10, the inductively heatable susceptor sheets 18 and the first and second sheet material 14*a*, 14*b* in the punching position, the punching element 32 is moved towards the cavity 44 of the mould 34 as shown by the arrow in FIG. 4. The peripheral edge 38 of the punching element 32 cuts the first sheet material 14*a*, the aerosol generating material 10 and the inductively heatable susceptor sheets 18 via shearing as it moves towards the cavity 44. The cut portions of the first sheet material 14*a*, the aerosol generating material 10 and the inductively heatable susceptor sheets 18 are received inside the hollow interior portion 42 of the punching element 32 to form part of the aerosol generating pod 1 shown in FIGS. 16*a* and 16*b*.

Figure 5:
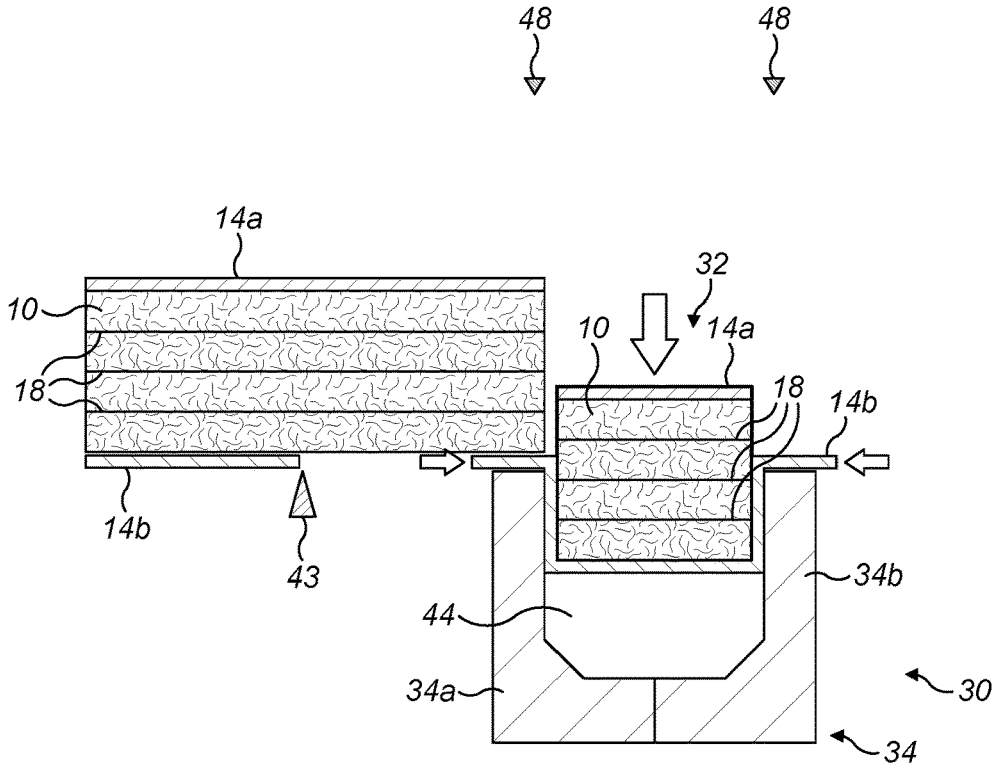
Figure 6:
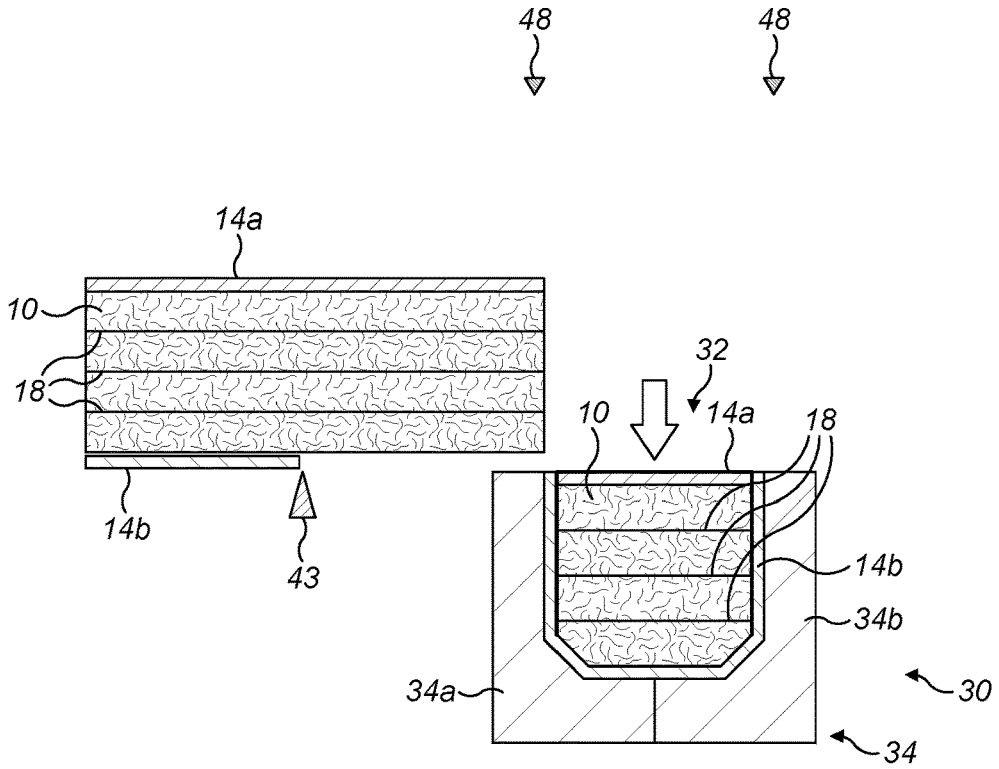

Continued movement of the punching element 32 into the cavity 44 of the mould 34 as shown by the arrows in FIGS. 5 and 6 pushes a separated portion of the second sheet material 14*b* into the cavity 44 and wraps it around the exposed side regions of the aerosol generating material 10.

Figure 7:
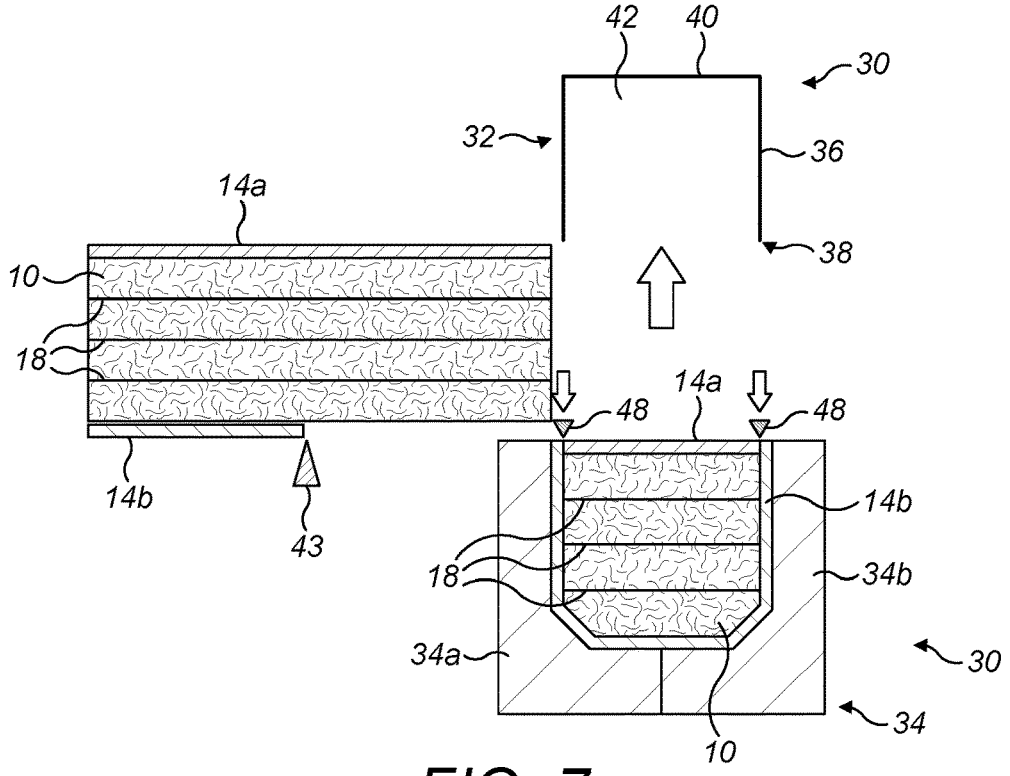

The punching element 32 is then withdrawn from the cavity 44 of the mould 34 as shown by the larger arrow in FIG. 7 and a joining unit 48 which in the illustrated embodiment has a circular shape, for example in the form of a sealing heater, is moved towards the mould 34 as shown by the smaller arrows in FIG. 7 so that it can apply heat to the peripheral edge of the cut portion of the first sheet material 14*a* and the upper peripheral edge of the separated portion of the second sheet material 14*b* where they contact each other. This seals the first sheet material 14*a* and the second sheet material 14*b* together, thereby forming an aerosol generating pod 1 in which the aerosol generating material 10 and the inductively heatable susceptor 18 is fully enclosed by the sheet material 14.

In some embodiments, the separated portion of the second sheet material 14*b* may be dimensioned so that there is substantially no excess second sheet material 14*b* projecting from the upper edge of the cavity 44 as shown in FIG. 6 and such that an upper peripheral edge of the separated portion of the second sheet material 14*b* contacts a peripheral edge of the cut portion of the first sheet material 14*a*. In practice, such accurate dimensioning of the separated portion of the second sheet material 14*b* may be difficult to achieve and the separated portion of the second sheet material 14*b* may instead be dimensioned so that there is a sufficient area of the second sheet material 14*b* to cover the exposed side regions of the aerosol generating material 10 and so that there is excess second sheet material 14*b* projecting from the upper edge of the cavity 44. In this case, any excess second sheet material 14*b* can be cut and removed after the first sheet material 14*a* and the second sheet material 14*b* have been sealed together by the joining unit 48 or can be left in situ as part of the aerosol generating pod 1.

Figure 9:
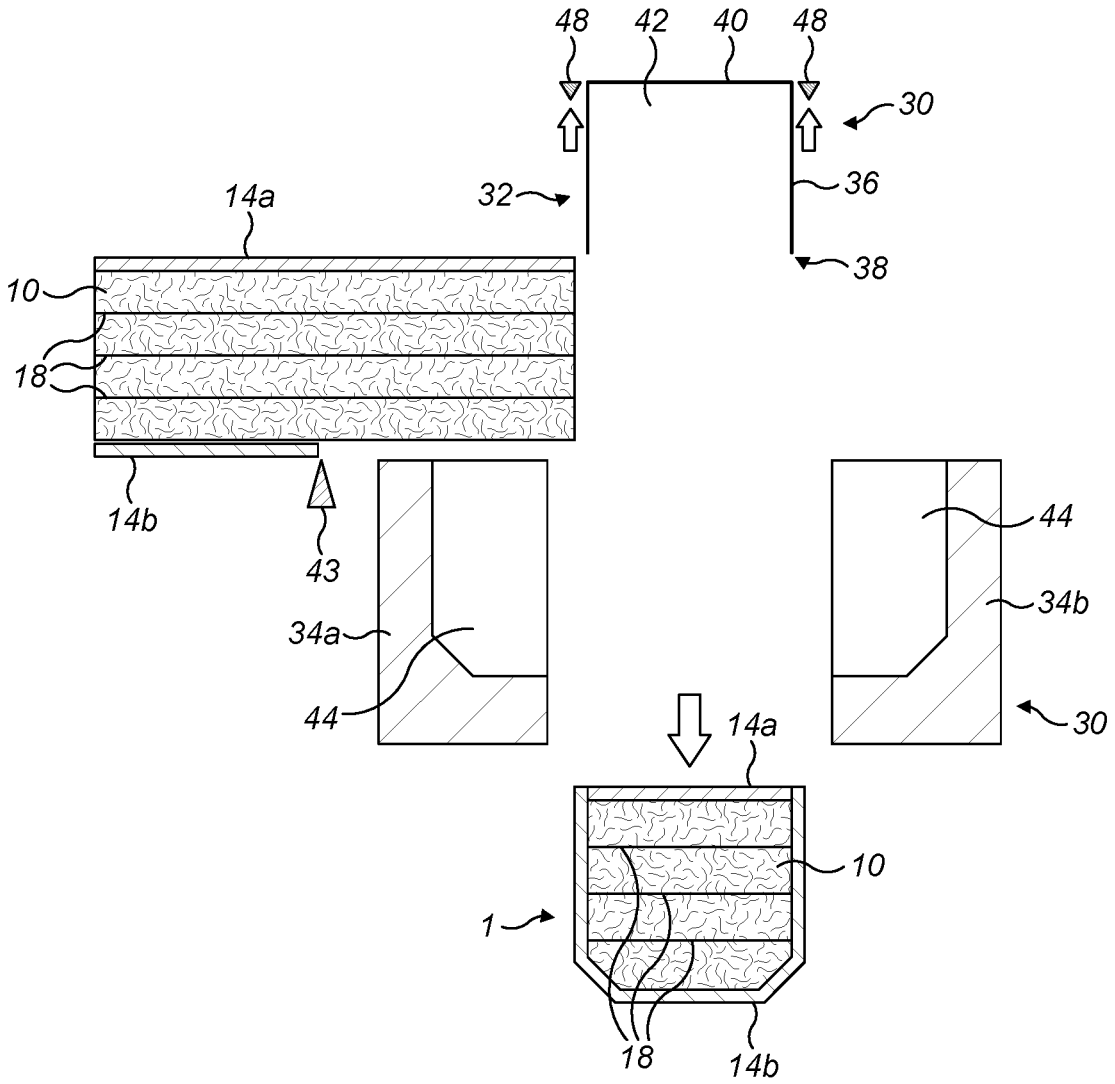
Figure 10:
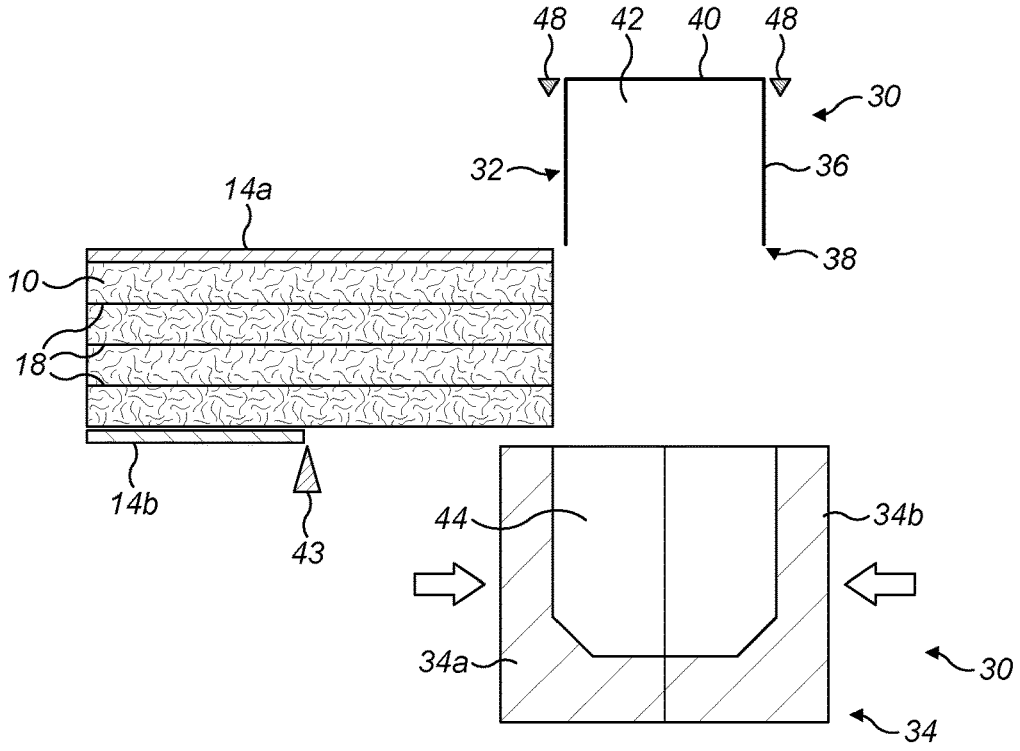
Figure 11:
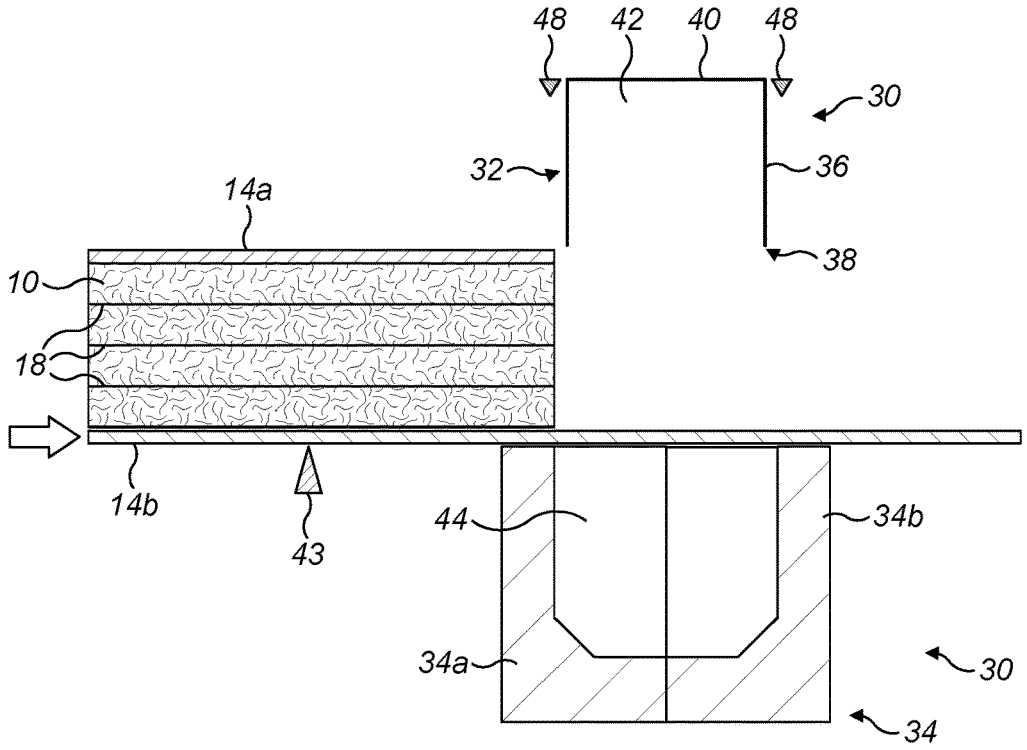
Figure 12:
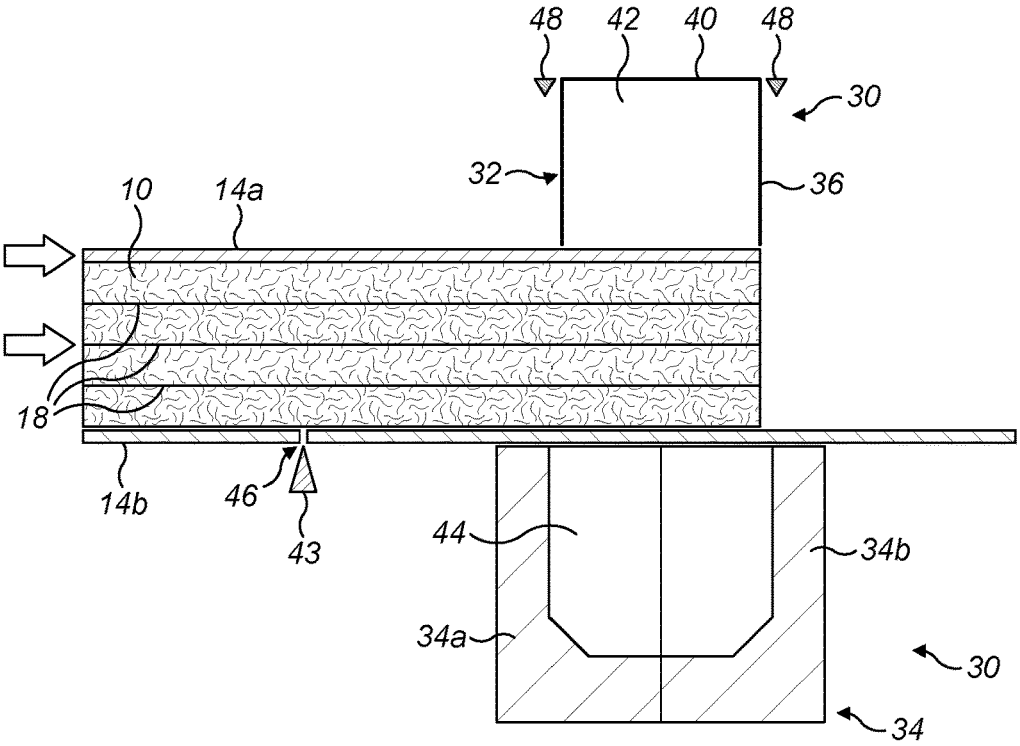

After the first sheet material 14*a* and the second sheet material 14*b* have been heated to seal them together, the joining unit 48 is moved to its original position as shown by the small vertical arrows in FIGS. 8 and 9 and the first and second mould parts 34*a*, 34*b* are separated as shown by the horizontal arrows in FIG. 8 to release the aerosol generating pod 1 from the cavity 44 of the mould 34 as shown by the arrow in FIG. 9. The first and second mould parts 34*a*, 34*b* are then moved back to their original position, as shown by the arrows in FIG. 10.

The method described above is performed continuously to enable the mass production of aerosol generating pods 1. Thus, referring to FIG. 11, a further section of the second sheet material 14*b* is advanced to the punching position as denoted by the arrow so that it overlies the cavity 44 of the mould 34 as described above. Further sections of the first sheet material 14 and the aerosol generating material 10 including the inductively heatable susceptor sheets 18 are also moved to the punching position as shown by the arrows in FIG. 12. The cutting unit 43 is again operated to cut the second sheet material 14*b* or to create a weakened region 46 in the second sheet material 14*b* as discussed above. The steps described above are then repeated continuously to produce further aerosol generating pods 1.

Figure 13:
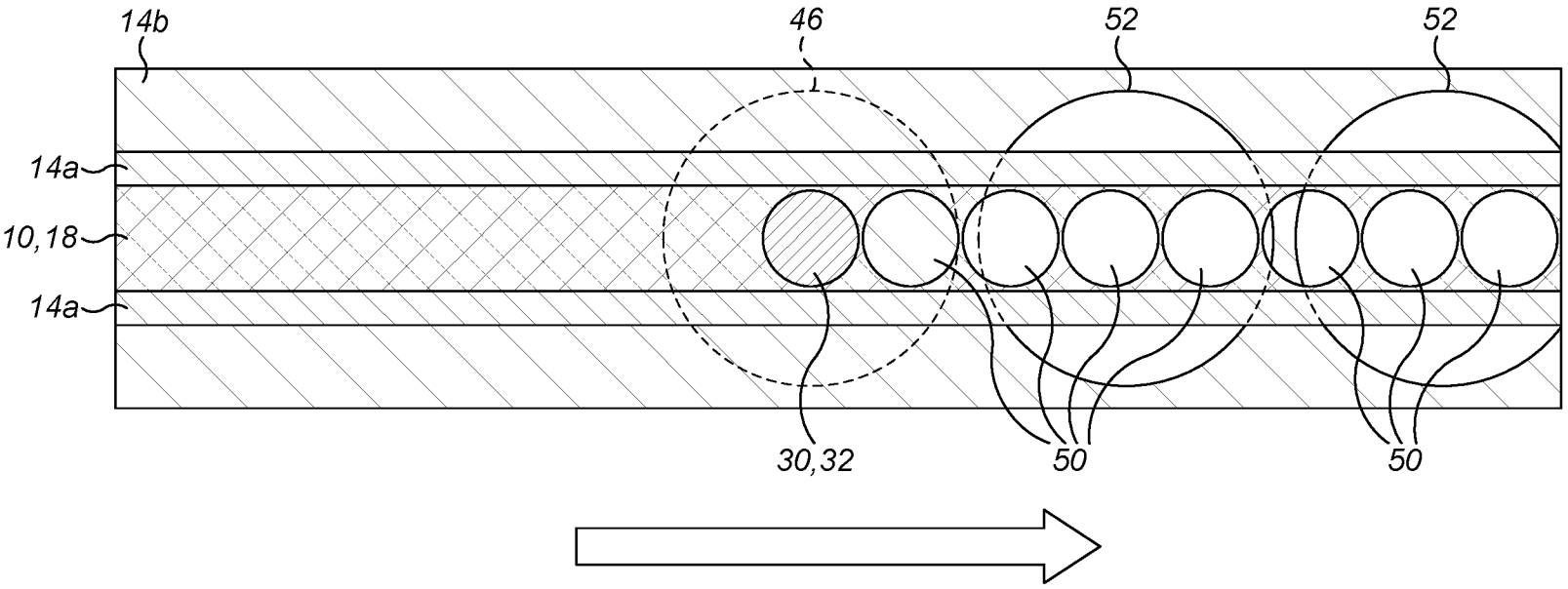
FIGS. 13 and 14 are top views of the method and apparatus illustrated in FIGS. 3 to 12, illustrating respectively first and second implementations.

In a first implementation shown in FIG. 13, the apparatus (in particular the supply units) is configured to move the first sheet material 14*a*, the aerosol generating material 10 and the inductively heatable susceptor sheets 18 by a smaller distance than the second sheet material 14*b* to transfer the first sheet material 14*a*, the second sheet material 14*b* and the aerosol generating material 10 including the inductively heatable susceptor sheets 18 to the punching position in the direction denoted by the arrow. As will be apparent from FIG. 13, in this first implementation the punching element 32 punches the first sheet material 14*a*, the aerosol generating material 10 and the inductively heatable susceptor sheets 18 in the manner described above thereby creating a series of holes 50 via shearing which are immediately adjacent to each other. A maximum usage of the first sheet material 14*a*, the aerosol generating material 10 and the inductively heatable susceptor sheets 18 is thereby achieved and the first implementation may thus provide a particularly efficient use of these materials, with minimum waste. As will be appreciated, the large circle denoted in FIG. 13 by the broken line corresponds to the weakened region 46 in the second sheet material 14*b* as described above whilst the large circles denoted by the solid lines indicate holes 52 in the second sheet material 14*b* that are formed due to separation of a portion of the second sheet material 14*b* by the punching element 32, as described above with reference to FIGS. 5 and 6.

Figure 14:
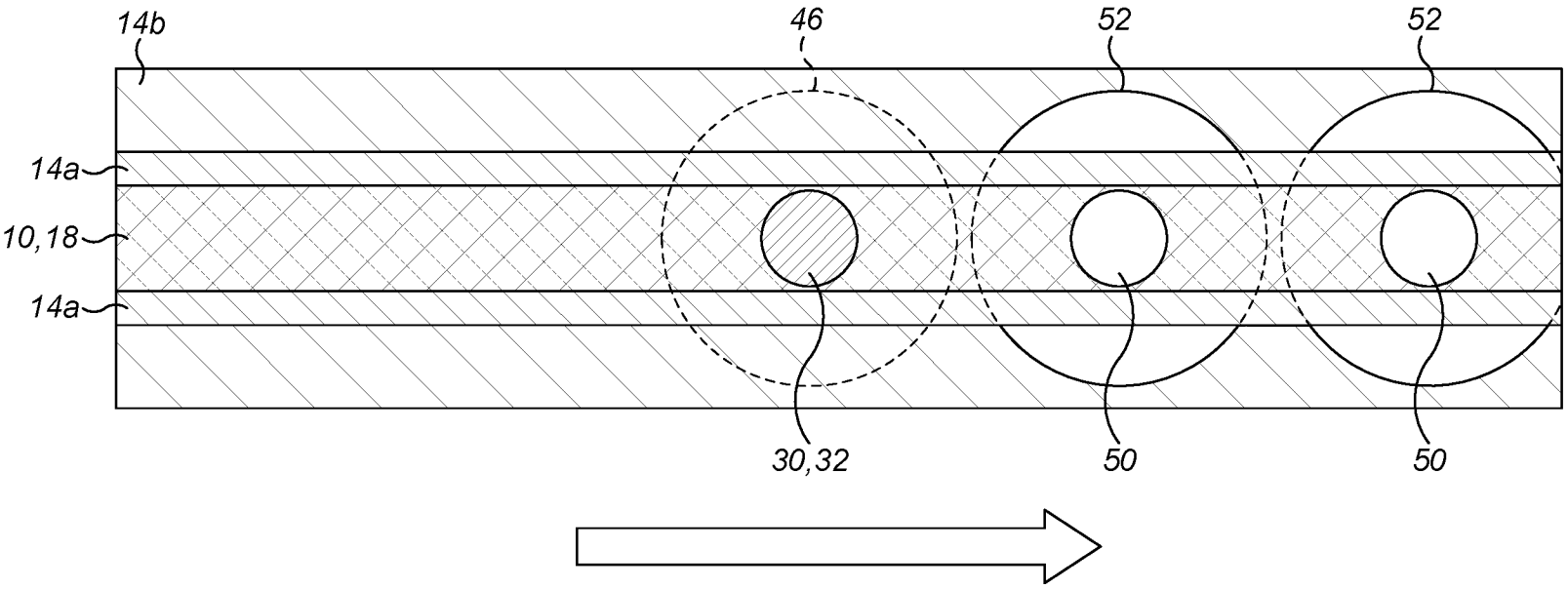

In a second implementation shown in FIG. 14, the apparatus (in particular the supply units) is configured to move the first sheet material 14*a*, the second sheet material 14*b*, the aerosol generating material 10 and the inductively heatable susceptor sheets 18 by the same distance to transfer the first sheet material 14*a*, the second sheet material 14*b* and the aerosol generating material 10 including the inductively heatable susceptor sheets 18 to the punching position in the direction denoted by the arrow. As will be apparent from FIG. 14, in this second implementation the punching element 32 punches the first sheet material 14*a*, the aerosol generating material 10 and the inductively heatable susceptor sheets 18 in the manner described above thereby creating a series of holes 50 via shearing which are spaced apart from each other, leaving unused regions of the first sheet material 14*a*, the aerosol generating material 10 and the inductively heatable susceptor sheets 18 between the holes 50 as is clearly apparent in FIG. 14. Although the first sheet material 14*a*, the aerosol generating material 10 and the inductively heatable susceptor sheets 18 may be used less efficiently due to the presence of the unused regions between the holes 50, the second implementation allows the apparatus and method of manufacture to be simplified. As will be appreciated, the large circle denoted in FIG. 14 by the broken line corresponds to the weakened region 46 in the second sheet material 14*b* as described above whilst the large circles denoted by the solid lines indicate holes 52 in the second sheet material 14*b* that are formed due to separation of a portion of the second sheet material 14*b* by the punching element 32, as described above with reference to FIGS. 5 and 6.

Figure 15:
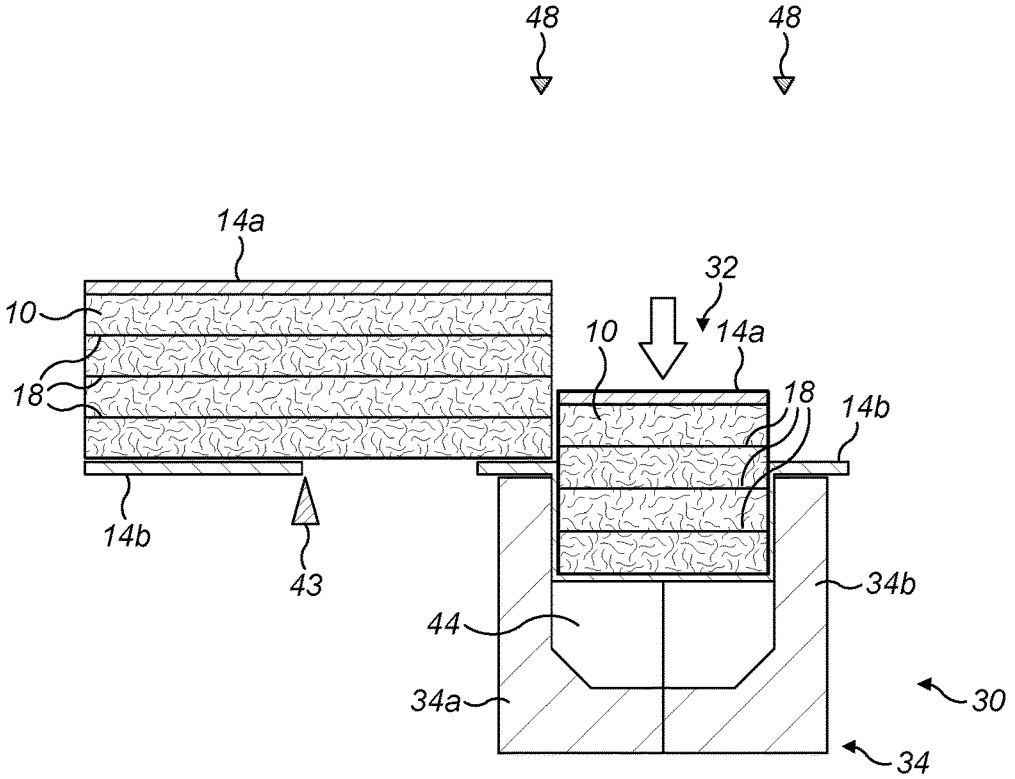
FIG. 15 is a diagrammatic cross-sectional side view similar to FIG. 5 illustrating stretching of the sheet material on one side of the aerosol generating material.

FIG. 15 illustrates a variation of the method described above in which the second sheet material 14*b* is deformed, and in particular stretched, as it is pushed into the cavity 44 of the mould 34 by the punching element 32 as shown by the arrow in FIG. 15. With this variation of the method, the difference in the feed rate between the first sheet material 14*a* and the second sheet material 14*b* (as supplied by the corresponding second supply units 12) can be minimised because a smaller quantity of the second material 14*b* is required to cover the aerosol generating material 10 and inductively heatable susceptor sheets 18 during movement of the punching element 32 into the cavity 44 due to the elongation of the second sheet material 14*b* during the punching process.

The aerosol generating pod 1 manufactured by the above method and corresponding to the embodiment of FIG. 8 is shown in FIGS. 16*a* and 16*b*. The aerosol generating pod 1 comprises aerosol generating material 10 and a plurality of susceptor elements 18*a* which are formed by the cut portions of the inductively heatable susceptor sheets 18. The apertures 22 in the susceptor elements 18*a* facilitate the flow of air and vapour through the aerosol generating pod 1, for example towards an outlet (e.g. a mouthpiece) of an aerosol generating device. The aerosol generating material 10 and the susceptor elements 18*a* are fully enclosed by the sheet material 14 (first sheet material 14*a* and second sheet material 14*b*) to form a sealed aerosol generating pod 1.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

For example, although the apparatus of FIGS. 1 and 2 include third supply units 16 for positioning an inductively heatable susceptor 18 in the aerosol generating material 10, the third supply units 16 may be omitted so that the resulting aerosol generating pod 1 comprises only aerosol generating material 10 covered by the sheet material 14. In this case, the aerosol generating pod 1 could be used with an aerosol generating device which employs a resistive heating system, for example in which a resistive heating element penetrates and/or is arranged proximate the aerosol generating pod 1 so that it can heat the aerosol generating material 10 within the aerosol generating pod 1 when the aerosol generating pod 1 is positioned in a heating compartment of the aerosol generating device. The aerosol generating pod 1 could equally be used with an aerosol generating device which employs an induction heating system, for example in which an inductively heatable susceptor penetrates and/or is arranged proximate the aerosol generating pod 1 so that it can heat the aerosol generating material 10 within the aerosol generating pod 1 when the aerosol generating pod 1 is positioned in a heating compartment of the aerosol generating device.

It is not strictly necessary to use a first sheet material 14*a* and a second sheet material 14*b* to cover the aerosol generating material 10 and the optional inductively heatable susceptor 18, and a single sheet material 14 could instead be used.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A method of manufacturing an aerosol generating pod, the method comprising:

(i) providing aerosol generating material and positioning an inductively heatable susceptor in the aerosol generating material;

(ii) positioning first and second sheet materials over opposite sides, respectively, of the aerosol generating material;

(iii) punching the aerosol generating material and sheet material from one of the opposite sides to form an aerosol generating pod comprising the aerosol generating material covered by sheet materials, wherein, after punching, the first and second sheet materials from opposite sides of the aerosol generating material are in contact.

2. The method according to claim 1, wherein:

step (i) comprises supplying the aerosol generating material having a continuous profile;

step (ii) comprises supplying the first and second sheet materials as continuous sheet materials over the opposite sides, respectively, of the continuous profile of the aerosol generating material;

step (iii) comprises repeatedly punching the continuous profile of the aerosol generating material and continuous sheet material from one of the opposite sides to form a plurality of aerosol generating pods comprising the aerosol generating material covered by the first and second sheet materials.

3. The method according to claim 1, wherein the inductively heatable susceptor is an inductively heatable susceptor sheet.

4. The method according to claim 3, wherein the inductively heatable susceptor sheet includes an aperture.

5. The method according to claim 1, wherein step (i) comprises positioning the aerosol generating material between the first or second sheet material and a sheet of the inductively heatable susceptor and/or between sheets of the inductively heatable susceptor.

6. The method according to claim 1, further comprising prior to step (iii):

cutting the first or second sheet material positioned on at least one of the opposite sides of the aerosol generating material to separate a cut first or second sheet material from a remaining first or second sheet material or creating a weakened region in the first or second sheet material positioned on at least one of the opposite sides of the aerosol generating material to facilitate cutting and separation of the first or second sheet material from the remaining first or second sheet material during step (iii).

7. The method according to claim 1, wherein step (iii) comprises moving a punching element towards the first or second sheet material positioned on one of the opposite sides of the aerosol generating material and into a cavity of a mould adjacent to the other of the first or second sheet material positioned on the opposite side of the aerosol generating material.

8. The method according to claim 7, wherein step (iii) comprises moving the punching element towards the first or second sheet material positioned on the one side of the aerosol generating material and pushing the other of the first or second sheet material positioned on the opposite side of the aerosol generating material into the cavity of the mould to thereby wrap exposed regions of the aerosol generating material with the first and second sheet materials.

9. The method according to claim 1, further comprising after step (iii):

joining the first and second sheet materials positioned on the opposite sides of the aerosol generating material to secure the aerosol generating material inside the first and second sheet materials.

10. An apparatus for manufacturing an aerosol generating pod, the apparatus comprising:

a first supply unit for supplying aerosol generating material;

a second supply unit for positioning first and second sheet material over opposite sides of the aerosol generating material;

a third supply unit for positioning an inductively heatable susceptor in the aerosol generating material, and a punching unit arranged to punch the aerosol generating material and the sheet material from one of the opposite sides to form an aerosol generating pod comprising the aerosol generating material covered by the sheet material.

11. The apparatus according to claim 10, wherein the punching unit comprises a punching element adjacent to the sheet material positioned on one of the opposite sides of the aerosol generating material and a mould having a cavity adjacent to the sheet material positioned on the opposite side of the aerosol generating material, the punching element being movable into the cavity of the mould to form the aerosol generating pod.

12. The apparatus according to claim 11, wherein the punching element includes a peripheral wall having a peripheral edge adapted to separate the sheet material positioned on the side of the aerosol generating material adjacent to the punching element from the remaining sheet material positioned on said side and to push the sheet material positioned on the opposite side of the aerosol generating material into the cavity of the mould to thereby wrap exposed regions of the aerosol generating material with the sheet material.

13. The apparatus according to claim 10, further comprising a joining unit adapted to join the sheet material positioned on the opposite sides of the aerosol generating material to secure the aerosol generating material inside the sheet material.

* * * * *